United States Patent [19]

Sakaguchi et al.

[11] Patent Number: 4,703,791

[45] Date of Patent: Nov. 3, 1987

[54] APPARATUS AND METHOD FOR CONTINUOUSLY PRODUCING THIN METALLIC STRIP

[75] Inventors: Haruo Sakaguchi; Teruyoshi Suehiro, both of Osaka; Kohsuke Terada, Matsubara; Minoru Ueda, Kawachinagano; Kunio Nagai, Osaka; Toshie Hashimoto, Izumi; Hisaki Nishiyama, Toyonaka; Masakazu Mohri, Takatsuki, all of Japan

[73] Assignee: Hitachi Zosen Corporation, Osaka, Japan

[21] Appl. No.: 849,008

[22] Filed: Apr. 7, 1986

[30] Foreign Application Priority Data

Apr. 10, 1985 [JP] Japan ..... 60-75987

[51] Int. Cl.[4] ..... B22D 11/12; B22D 11/06

[52] U.S. Cl. ..... 164/417; 164/424; 164/428

[58] Field of Search ..... 164/476, 424, 480, 428, 164/417; 72/53

[56] References Cited

U.S. PATENT DOCUMENTS

| | | | |
|---|---|---|---|
| 2,058,448 | 10/1936 | Hazelett | 164/480 |
| 3,827,270 | 8/1974 | Neilsen | 72/53 |
| 3,857,750 | 12/1974 | Winter et al. | 72/53 |
| 4,416,130 | 11/1983 | Judge, Jr. | 72/53 |
| 4,532,980 | 8/1985 | Miyawaki et al. | 164/476 |

FOREIGN PATENT DOCUMENTS

| | | | |
|---|---|---|---|
| 10308 | 1/1980 | Japan | 72/53 |
| 159947 | 9/1983 | Japan | 164/480 |
| 209451 | 12/1983 | Japan | 164/480 |
| 218357 | 12/1983 | Japan | 164/428 |
| 206147 | 11/1984 | Japan | 164/476 |

*Primary Examiner*—Nicholas P. Godici
*Assistant Examiner*—Samuel M. Heinrich
*Attorney, Agent, or Firm*—Joseph W. Farley

[57] ABSTRACT

An apparatus for continuously producing a thin metallic strip comprises a mold 3 adapted to receive molten metal and having an outlet opening 1*a* through which the molten metal under solidification is drawn out as a casting 10 for guided withdrawal movement along a predetermined path, and surface smoothing devices 5 for generally continuously impacting both opposite surfaces of the casting 10 adjacent the outlet opening of the mold.

2 Claims, 6 Drawing Figures

APPARATUS AND METHOD FOR CONTINUOUSLY PRODUCING THIN METALLIC STRIP

FIELD OF THE INVENTION

This invention relates to an apparatus and method for continuously producing a thin metallic strip, and more spcifically to improvements in the continuous production of a thin metallic strip in which a casting is drawn through a mold for guided withdrawal movement along a path provided by plural pairs of guide rolls.

BACKGROUND OF THE INVENTION

A typical apparatus for continuously producing a metal strip comprises a mold including a pair of mold rolls opposed to each other with a clearance defining an outlet opening, and a melt receiver arranged above the rolls in contact therewith. Molten metal supplied into the mold is withdrawn under solidification through the outlet opening to produce a casting which is thereafter guided along a path provided by plural pairs of guide rolls.

As is well known, a casting (metal strip) produced by such an apparatus usually has on the opposite surfaces thereof depressions of about 0.1 mm in depth extending widthwise of the casting and spaced longitudinally at intervals of about 0.1 to 0.4 mm. These depressions, which are known as "tear marks" degrading the product value, are believed to be formed for the following reason. The molten metal in the mold continuously solidifies on the relatively cold rotating mold rolls to form a shell bifurcated from the upper end of the casting, whereas the melt also forms into a solidified shell on the interior surface of the melt receiver adjacent the mold rolls to ultimately merge into the bifurcated shell on the mold roll side. As the casting is continuously withdrawn at a constant speed, the thus merged shells are immediately torn apart, and they join together again after a certain interval. Such process repeatedly occurs at intervals to form a tear mark every time both shells are torn apart.

In case a casting has a large thickness, such tear marks can be eliminated by rolling the casting to provide an improved quality. But in the case of a thin casting, there is virtually no room for rolling to remove the tear marks, thus leading to a deteriorated product quality.

SUMMARY OF THE INVENTION

It is, therefore, an object of present invention to provide an apparatus and method for continuously producing a thin metallic strip which is free of tear marks.

According to one aspect of the present invention, an apparatus is provided for continuously producing a thin metallic strip, which comprises a mold adapted to receive molten metal and having an outlet opening through which the molten metal under solidification is drawn out as a casting for guided withdrawal movement along a predetermined path, and surface smoothing means for substantially continuously impacting both opposite surfaces of the casting adjacent the outlet opening of the mold.

With the above construction, since the surface smoothing means is arranged adjacent the outlet opening of the mold, it can impact the casting in a still hot and soft state and thereby smooth the opposite surfaces of the casting enough to eliminate tear marks.

The surface smoothing means may comprise at least a pair of rotary beaters, shot blast devices, or hammering devices.

According to another aspect of present invention, a method is provided for continuously producing a thin metallic strip, which comprises generally continuously impacting both opposite surfaces of a casting being drawn through a mold along a predetermined path while the casting is still incompletely hardened.

A best result for a casting of a steel alloy is obtained by conducting the impacting operation while the casting has a surface temperature of 1200° to 1350° C. No noticeable effect is achieved by impacting the casting having its surface temperature lowered to less than 1000° C.

Numerous features and advantages of the present invention will be readily understood from the following description of preferred embodiments given with reference to the accompanying drawings.

DETAILED DESCRIPTION

Figure 1:
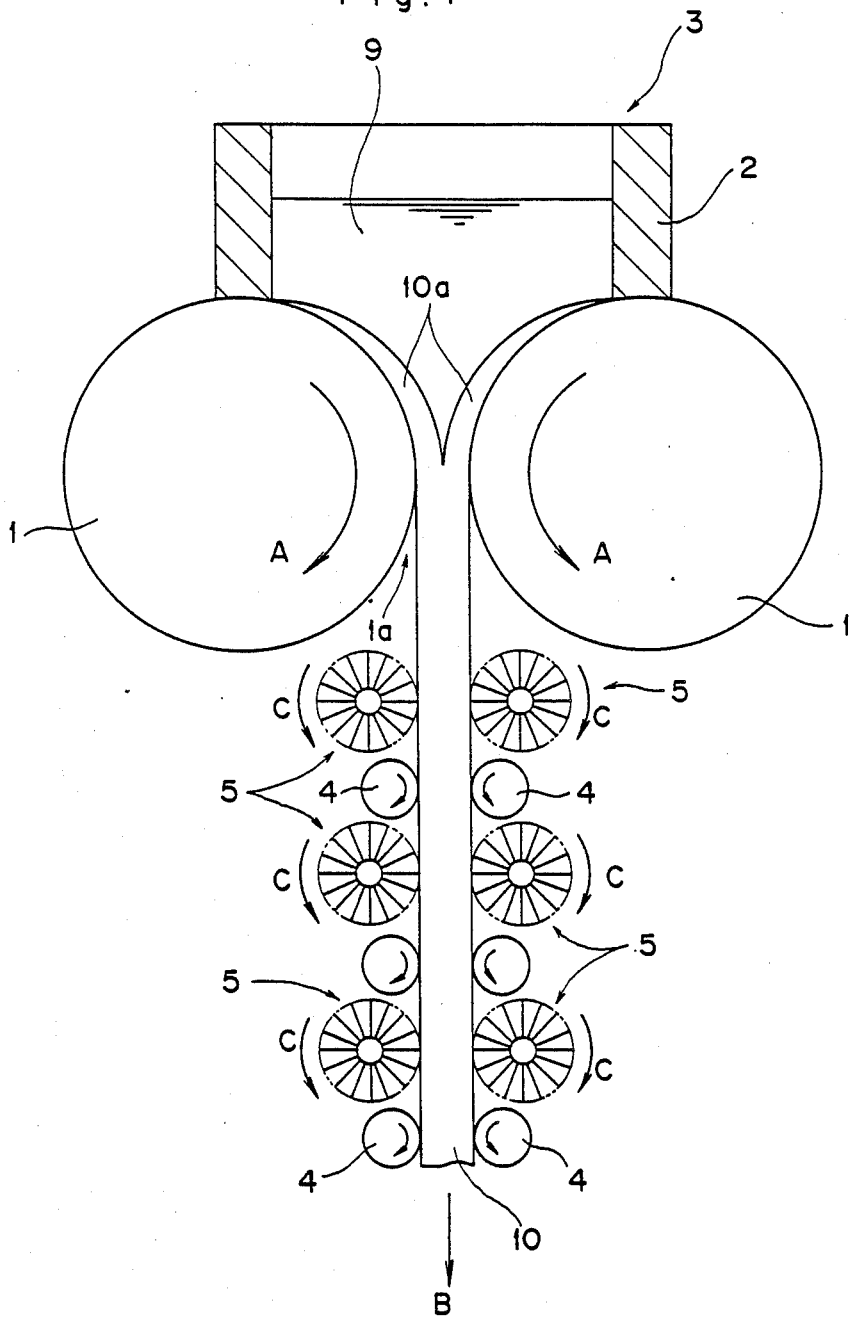
FIG. 1 is a schematic side elevation, partly in section, of a continuous casting apparatus embodying the invention with rotary beaters incorporated as surface smoothing means.

Referring now to FIG. 1, numeral 1 represents a pair of mold rolls opposed to each other with a predetermined clearance to define an outlet opening 1*a*. A melt receiver 2 is arranged above the mold rolls 1 in contact therewith. The mold rolls 1 and the receiver 2 constitute a mold 3. Plural pairs (only 3 pairs shown in FIG. 1) of opposed guide rollers 4 are arranged below the mold 3 to form a withdrawal path. According to this embodiment, three pairs of opposed rotary beaters 5 are disposed immediately below the mold rolls 1 in three stages on both sides of the withdrawal path.

Figure 2:
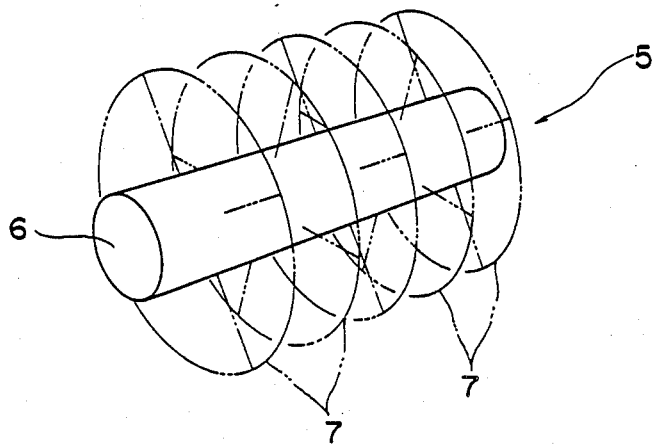
FIG. 2 is a schematic perspective view of the rotary beater.
Figure 3:
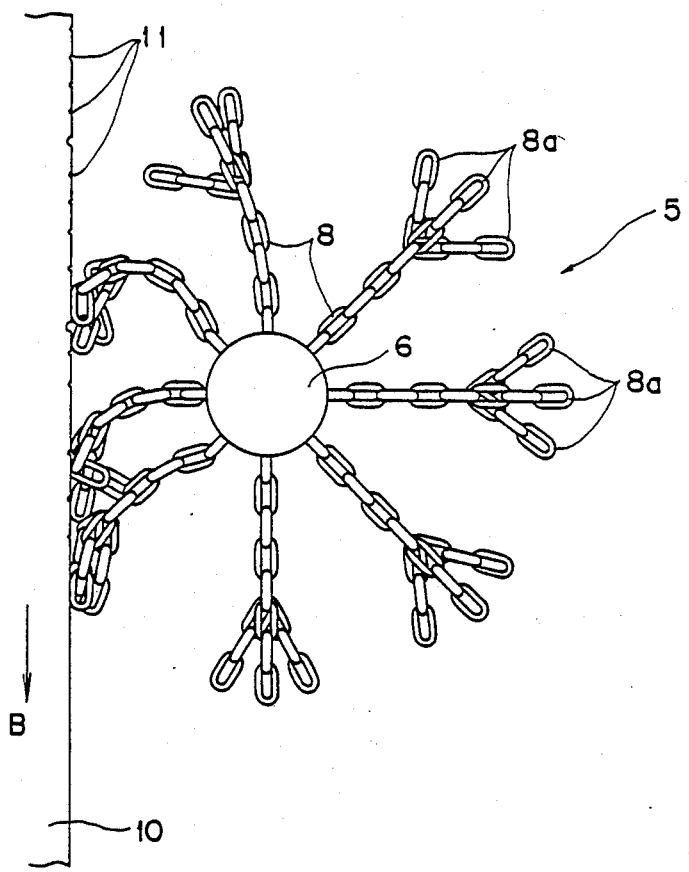
FIG. 3 is a side view showing one form of the rotary beater in greater detail.

As shown in FIG. 2, each rotary beater 5 comprises a rotary shaft 6 and plural beating portions 7 equidistantly spaced axially of the shaft 6. Each beating portion 7, as shown in FIG. 3, includes a plurality of branched chains 8 each fixed at one end to the rotary shaft 6 at each of equiangularly spaced positions and having chain branches 8*a* flaring to give an increased beating range. Although not clearly illustrated, it should be understood that the beating portions 7 in one stage are positioned between the beating portions 7 in an adjacent stage, so that the rotary beaters 5 altogether provide a combined beating range enough to cover the entire width of a casting 10 without omission.

The continuous casting apparatus having the above construction operates as follows.

First, a dummy bar (not shown) is inserted between the mold rolls 1 from below to plug the outlet opening 1*a*, and a steel alloy melt 9 is supplied into the melt receiver 2. The melt 9 forms a bifurcated shell 10*a* upon contact with the mold rolls 1 under cooling. Subsequently, with the mold rolls 1 in rotation as indicated by arrow A, the dummy bar is pulled downward to cause the casting (thin metallic strip) 10 to be withdrawn along the drawing path provided by the guide rollers 4 as indicated by arrow B. During the above descibed continuous casting operation, the rotary beaters 5 are continuously rotated as indicated by arrow C. As a result, the branched chains 8 of each rotary beater 5 are centrifugally stretched radially, so that the branched chain free ends 8*a* successively collide against a corresponding surface of the still incompletely hardened casting 10. Thus, the casting 10 is substantially continuously impacted, and depressions thereon, i.e., tear marks, are eliminated (refer to FIG. 3).

Casting conditions which would lead to a good result are given below by way of example.

| | |
|---|---|
| Thickness of casting 10 | 20 mm |
| Withdrawal speed of casting 10 | 5 m/min. |
| Surface temperature of casting 10 | 1200 to 1350° C. |
| Depth of depressions 11 | 0.02 to 0.1 mm |
| Interval between depressions 11 | 2.0 to 3.0 mm |
| Number of rotory beaters 5 | 2 pairs |
| Number of chain branches 8a in each beating portion 7 | 40 |
| Weight of each chain link in each chain branch 8a | 1.5 g |
| Diameter of each rotory beater 5 in rotation | 100 mm |
| Rotational speed of each rotary beater 5 | 400 rpm |

The number of the beating portions 7 in each rotary beater 5 may be varied depending on the width of the casting 10 to be produced. The number of the rotary beater pairs may also be altered to match the other casting conditions.

Figure 4:
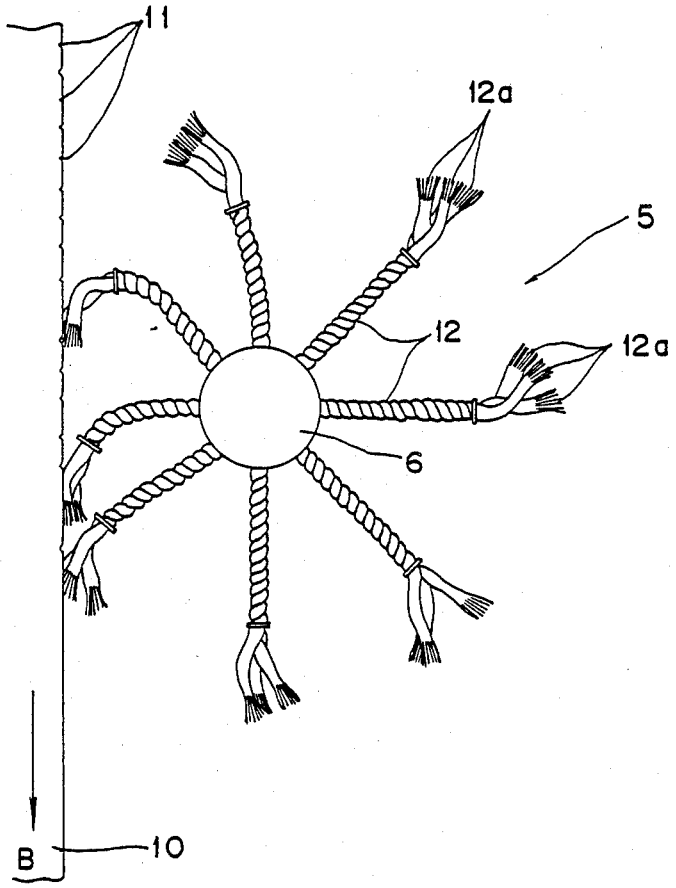
FIG. 4 is a view similar to FIG. 3 but showing another form of the rotary beater.

Each branched chain 8 shown in FIG. 3 may be replaced by a branched wire rope 12 as shown in FIG. 4. The wire rope 12 comprises a multiplicity of stranded metal filaments and has rope branches 12*a* at the free end thereof.

Figure 5:
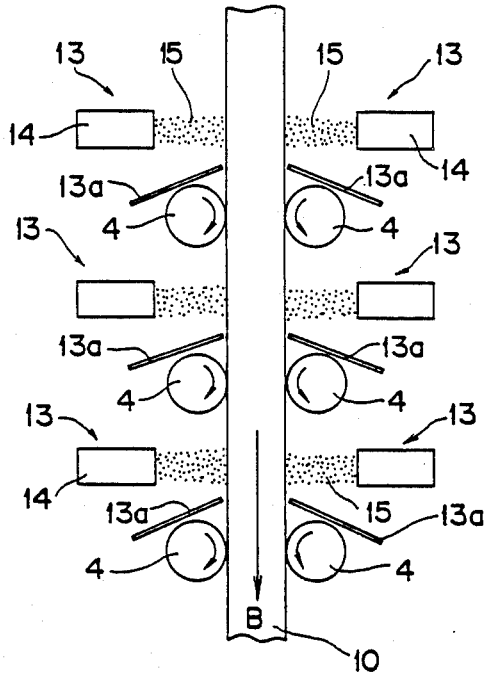
FIG. 5 is a schematic side elevation showing another continuous casting apparatus embodying the invention with shot blast devices incorporated as the surface smoothing means.

In another embodiment shown in FIG. 5, plural pairs of opposed shot blast devices 13 are arranged in three stages on both sides of the withdrawal path for a casting 10. Each blast device 13 comprises a blasting nozzle 14 connected to an unillustrated supply source and adapted to shoot hard solids such as steel beads or balls 15 to the casting 10. After having collided against the casting 10, the solids 15 are guided along a corresponding guide plate 13*a* to a collecting device (not shown). Depending on the width of the casting 10, each stage may incorporate plural pairs of such shot blast devices 13 spaced widthwise of the casting 10.

Figure 6:
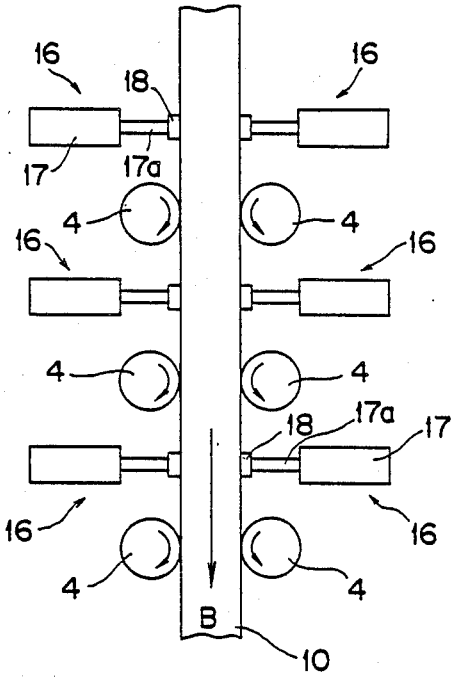
FIG. 6 is a schematic side elevation of a further continuous casting apparatus embodying the invention with hammering devices employed as the surface smoothing means.

FIG. 6 shows a further embodiment in which plural pairs of opposed hammering devices 16 are disposed in three stages on both sides of the withdrawal path for a casting 10. Each hammering device 16 has a vibrator 17 which is adapted to oscilate a hammering head 18 through a rod 17*a*. As in the embodiment of FIG. 5, plural pairs of such hammering devices 16 may be provided in each stage as spaced apart widthwise of the casting 10 in consideration of the width of the casting 10.

The present invention is not limited to the illustrated embodiments but can be modified within the scope obvious to those skilled in the art. For example, the embodiment of FIGS. 1 to 3 may be modified so that one or more spiral rows of branched chains are provided on the rotary shaft 6. Thus, it should be understood that the present invention is restricted only by the appended claims.

We claim:

1. An apparatus for continuously producing a thin metallic strip comprising a mold adapted to receive molten metal and having an outlet opening through which the molten metal is drawn out as a solidifying casting for guided withdrawal movement along a predetermined path, plural pairs of opposed guide rollers arranged adjacent the outlet opening of the mold on both sides of the casting withdrawal path and being engageable by the opposite surfaces of the casting, and plural pairs of opposed branched chain means arranged between said pairs of guide rollers, each of said branched chain means comprising a rotary shaft extending widthwise of the casting, and chain groups spaced apart axially of the rotary shaft, each chain group including a plurality of chains having base ends secured circumferentially equiangularly to said rotary shaft and having free ends provided with plural chain branches, said branched chain means being adapted to smooth the opposite surfaces of the casting by substantially continuously impacting them with the free ends of said chains in response to rotation of the rotary shafts.

2. An apparatus for continuously producing a thin metallic strip comprising a mold adapted to receive molten metal and having an outlet opening through which the molten metal is drawn out as a solidifying casting for guided withdrawal movement along a predetermined path, plural pairs of opposed guide rollers arranged adjacent the outlet opening of the mold on both sides of the casting withdrawal path and being engageable by the opposite surfaces of the casting, and plural pairs of opposed branched wire rope means arranged between said pairs of guide rollers, each of said branched wire rope means comprising a rotary shaft extending widthwise of the casting and wire rope groups spaced apart axially of the rotary shaft, each wire rope group including a plurality of wire ropes having base ends secured circumferentially equiangularly to said rotary shaft and having free ends provided with plural wire rope branches, said branched wire rope means being adapted to smooth the opposite surfaces of the casting by substantially continuously impacting them with the free ends of said wire ropes in response to rotation of the rotary shafts.

* * * * *